US009260235B2

(12) United States Patent
Dalpian

(10) Patent No.: US 9,260,235 B2
(45) Date of Patent: Feb. 16, 2016

(54) DENTURE CLEANING TABLET DISPENSING APPARATUS

(71) Applicant: David Dalpian, Waterford, MI (US)

(72) Inventor: David Dalpian, Waterford, MI (US)

( * ) Notice: Subject to any disclaimer, the term of this patent is extended or adjusted under 35 U.S.C. 154(b) by 0 days.

(21) Appl. No.: 14/273,780

(22) Filed: May 9, 2014

(65) Prior Publication Data

US 2014/0339250 A1 Nov. 20, 2014

Related U.S. Application Data

(60) Provisional application No. 61/823,348, filed on May 14, 2013.

(51) Int. Cl.
*B65D 83/04* (2006.01)
*A61J 7/00* (2006.01)

(52) U.S. Cl.
CPC ..... *B65D 83/0418* (2013.01); *A61J 7/0076* (2013.01)

(58) Field of Classification Search
CPC ..... A61J 7/0076; B65D 83/0418
USPC ..... 221/92, 113, 271, 276
See application file for complete search history.

(56) References Cited

U.S. PATENT DOCUMENTS

| | | | | |
|---|---|---|---|---|
| 198,536 | A | 12/1877 | Dewey | |
| 3,129,845 | A * | 4/1964 | Walton | 222/41 |
| 3,358,818 | A * | 12/1967 | Davis | 206/536 |
| 3,889,847 | A * | 6/1975 | Uroshevich et al. | 221/265 |
| 3,991,908 | A | 11/1976 | Thomas et al. | |
| 4,027,781 | A | 6/1977 | Covert | |
| 4,122,983 | A * | 10/1978 | Jolly | 222/390 |
| 4,127,190 | A * | 11/1978 | Sunnen | 206/535 |
| 4,262,802 | A | 4/1981 | Laauwe | |
| 322,905 | A | 1/1992 | Decker | |
| 6,241,120 | B1 * | 6/2001 | Scholey et al. | 221/186 |
| 7,240,795 | B2 | 7/2007 | Lee | |
| 2010/0300925 | A1 | 12/2010 | Kan | |
| 2010/0318218 | A1 * | 12/2010 | Muncy et al. | 700/220 |
| 2011/0192863 | A1 * | 8/2011 | Barrass et al. | 221/92 |
| 2012/0003928 | A1 * | 1/2012 | Geboers et al. | 455/41.1 |

FOREIGN PATENT DOCUMENTS

| | | | |
|---|---|---|---|
| DE | 3143953 | A1 | 5/1983 |
| EP | 1477403 | A1 | 11/2004 |
| EP | 1958891 | A2 | 8/2008 |
| EP | 1626914 | B1 | 4/2011 |
| KR | 20110000267 | U | 1/2011 |

* cited by examiner

*Primary Examiner* — Timothy Waggoner
(74) *Attorney, Agent, or Firm* — Vincent Re PLLC

(57) ABSTRACT

A dispenser can be utilized for selectively providing a denture cleaning tablet. The apparatus includes a rotatable storage container holding a plurality of columns of the tablets and a dispensing mechanism. The dispensing mechanism includes an input hole. A user of the dispenser can acquire a tablet through rotating the rotatable storage container to align one of the columns of tablets to the input hole and cycling the dispensing mechanism.

9 Claims, 13 Drawing Sheets

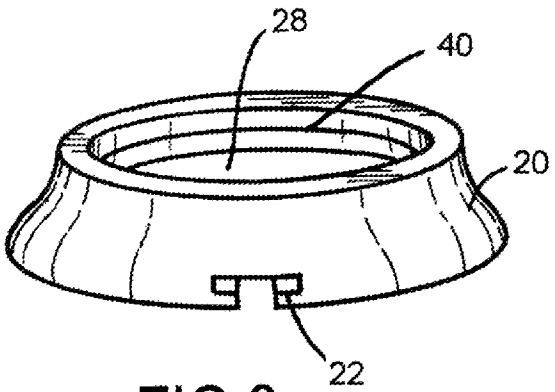
FIG.2
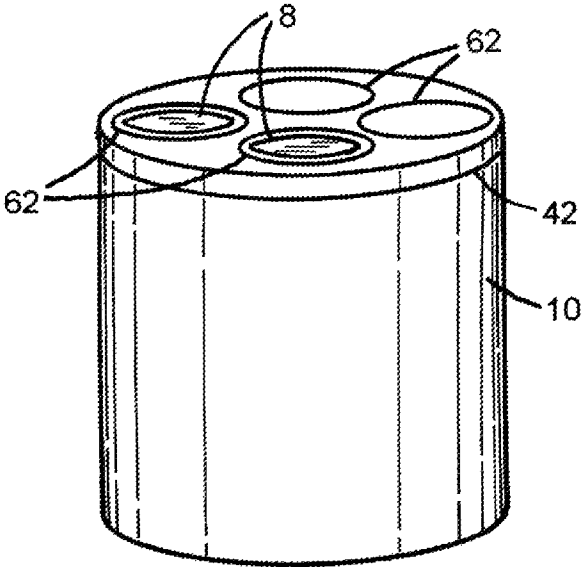

DENTURE CLEANING TABLET DISPENSING APPARATUS

CROSS REFERENCE TO RELATED APPLICATIONS

This disclosure claims the benefit of U.S. Provisional Application No. 61/823,348 filed on May 14, 2013 which is hereby incorporated by reference.

TECHNICAL FIELD

This disclosure is related to the dispensing of tablets, specifically the cleaning of dentures.

BACKGROUND

The statements in this section merely provide background information related to the present disclosure. Accordingly, such statements are not intended to constitute an admission of prior art.

Dentures, when worn daily, can pick up stains, especially if the wearer smokes or drinks a lot of tea, coffee or red wine. In most cases this staining is removable with regular cleaning. A common practice is to use an effervescent (fizzy) denture cleaner that is provided in tablet form. Denture cleaning tablets presently come in individually wrapped packaging where the consumer must squeeze the packaging and push the tablet through paper/foil to drop it into a cup. For older customers or customers with arthritis, such a routine can be difficult or painful, and some are physically unable to do so and must enlist the help of others. This individual foil/blister packaging is also wasteful and expensive, creating excessive waste that the consumer must then throw away.

SUMMARY

A dispenser can be utilized for selectively providing a denture cleaning tablet. The apparatus includes a rotatable storage container holding a plurality of columns of the tablets and a dispensing mechanism. The dispensing mechanism includes an input hole. A user of the dispenser can acquire a tablet through rotating the rotatable storage container to align one of the columns of tablets to the input hole and cycling the dispensing mechanism.

BRIEF DESCRIPTION OF THE DRAWINGS

One or more embodiments will now be described, by way of example, with reference to the accompanying drawings, in which:

FIG. 2 illustrates the storage container of FIG. 1 removed from the base and flipped over, in accordance with the present disclosure;

DETAILED DESCRIPTION

Figure 1:
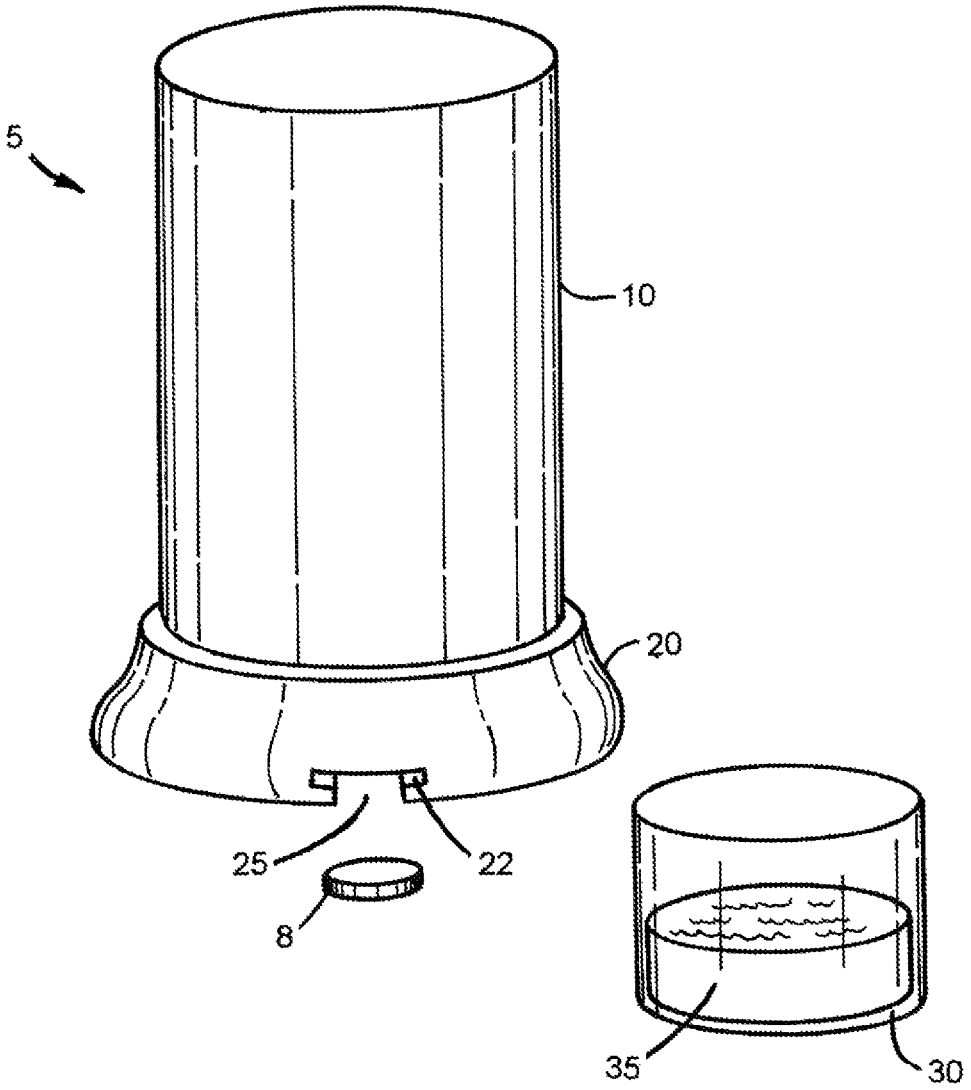
FIG. 1 illustrates a dispensing device including a cylindrical storage container attached to a dispensing base, in accordance with the present disclosure.

Referring now to the drawings, wherein the showings are for the purpose of illustrating certain exemplary embodiments only and not for the purpose of limiting the same, tablets are used for cleaning a denture. The tablet is acquired for the shipping packaging and dropped in water, wherein the chemicals in the tablet are activated and act to clean dentures dropped in the water. Packaging used for dentures can be difficult to open. In particular, a user with symptoms of age and/or arthritis can have difficulty opening individually wrapped tablets. An apparatus is provided that permits a column of tablets or several columns of tablets to be loaded into a dispenser and selectively provided through simple movements of the user's hand or of a cycling of a control tab.

FIG. 1 illustrates a dispensing device including a cylindrical storage container attached to a dispensing base. Storage container 10 holds in an organized fashion a product that is to be discreetly dispensed to a user. In one exemplary embodiment, the product to be dispensed includes denture cleaning tablets 8. In another embodiment, a granular denture cleaning product can be discreetly dispensed. While tablets 8 are illustrated in use throughout the application, it will be appreciated that very similar configurations can be used to discreetly cup and then dispense a granular product.

On the bottom of dispensing base 20, slot 22 is sized to permit a round tablet 8 to freely slide from within base 20 to outside the base. Slot 25 permits a user to slide a finger under slot 22 and manually move a tablet from an interior portion of base 20 to outside of base 20. A column of aligned tablets 8 can be stored within storage container 10, such that a tablet 8 on the bottom of the column of tablets is exposed to slot 22 and presented to the user for manual movement. As the bottom tablet 8 is removed, a next tablet 8 in the column falls to slot 22, such that it is present the next time the user needs a tablet. Tablet 8, once removed, can be placed in glass 30 filled with water 35 for use in denture cleaning known in the art.

Storage container 10 can be refillable. FIG. 2 illustrates storage container 10 removed from base 20 and flipped over. The interior of exemplary storage container 10 includes four cavities 62 which can be filled with columns of tablets 8. Two of the exemplary cavities 62 are illustrated filled, and two of the exemplary cavities 62 are illustrated unfilled.

Base 20 is illustrated including slot 22 and base surface 28 upon which, when storage container 10 is installed to base 20, storage container 10 rests. Base surface 28 includes an exemplary hole through which a tablet, when a column of tablets is aligned with the hole, can fall and be presented within slot 22 for manual movement by the user.

In one embodiment, storage container 10 snaps into and can rotate within base 20. Rotation of storage container 10 within base 20 permits a plurality of columns of tablets 8 to be aligned with the hole in base surface 28, such that each of the columns can be systematically used until the entire storage container is emptied. Each of the columns can be located at an equal radius from a center of the storage container 10, such that each of the columns can be placed in line with the hole in base surface 28. Details 40 and 42 illustrate matching tongue and groove details that enable a snapping function of storage container 10 into base 20, such that container 10 and base 20 are unified as a durable dispenser until the user pulls the container 10 from base 20. In order to install container 10 to base 20, one exemplary method is to fill container 20 in an upside down orientation, as illustrated in FIG. 2, install base 20 to container 10 while upside down, and then flip dispenser 5 into an upright position.

Figure 3:
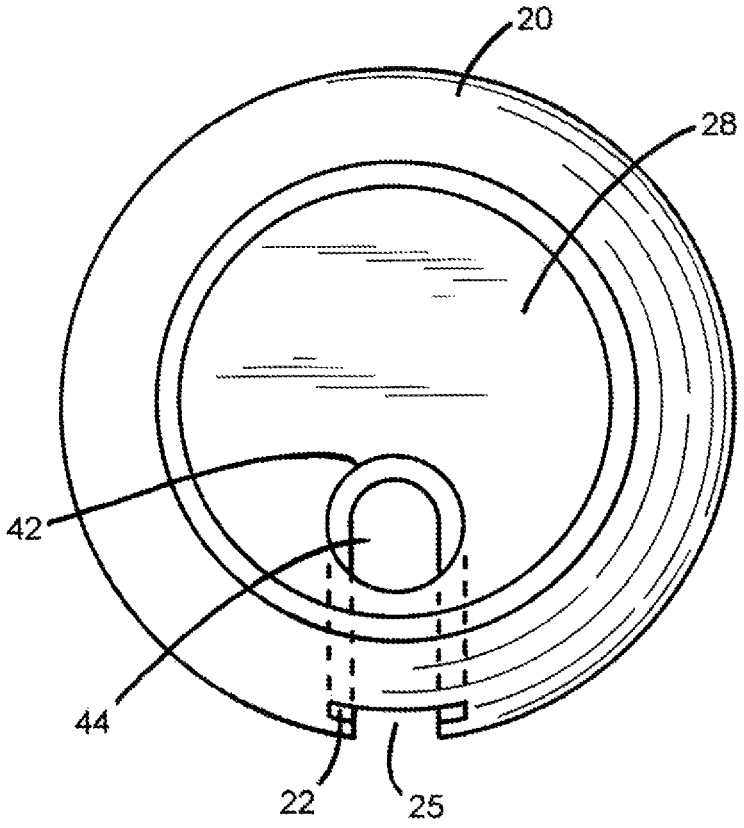
FIG. 3 illustrates the exemplary base plate of FIG. 2, in accordance with the present disclosure.

FIG. 3 illustrates the exemplary base plate of FIG. 2. Base plate 20 includes base surface 28, slot 22, and slot 25. Both slot 22 and slot 25 are illustrated connecting with hole 42 in bases surface 28 and finger-shaped opening 44, respectively. As a column of tablets are aligned to hole 42, a tablet falls into hole 42 and rests upon the side supports of slot 22. A user may put a finger into slot 25 and opening 44, apply a force upon a tablet within hole 42, and slide the tablet through slot 22.

Figure 4C:
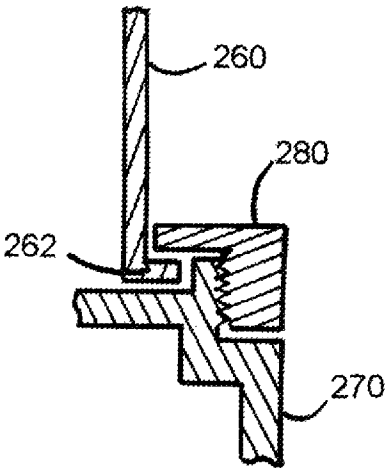
FIG. 4C illustrates an exemplary retention ring that can be screwed onto a base with an overhanging lip, retaining the storage container in place and permitting the container to rotate relative to the base, in accordance with the present disclosure.
Figure 4B:
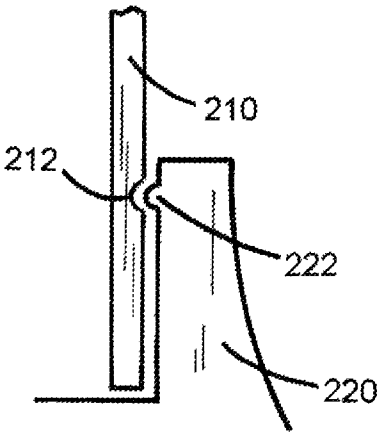
FIGS. 4A and 4B illustrate exemplary tongue and groove features that can enable a storage container to be snapped into a base, in accordance with the present disclosure.
Figure 4A:
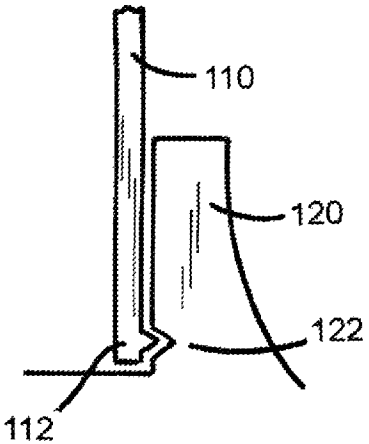

FIGS. 4A and 4B illustrate exemplary tongue and groove features that can enable a storage container to be snapped into a base. FIG. 4A illustrates a tongue 112 configured to storage container wall 110, and a groove 122 configured to base wall 120. FIG. 4B illustrates a tongue 222 configured to base wall 220 and a groove 212 configured to storage container wall 210. The size of the tongue and grooves and a tolerance of the diameter of the storage container and the base can each be changed to modulate how much force is required to install the storage container to the base and the force required to remove the storage container from the base. A storage container can include a slot or slots cut longitudinally in the wall to permit the storage container to be selectively squeezed to ease removal of the storage container from the base. A number of tongue and groove shapes, locations, and orientations are envisioned for use in snapping a storage container into a base, and the disclosure is not intended to be limited to the examples provided herein.

FIG. 4C illustrates an exemplary retention ring that can be screwed onto a base with an overhanging lip, retaining the storage container in place and permitting the container to rotate relative to the base. Base 270 is configured to receive storage container wall 260 including a turned out edge 262. Base 270 can be threaded around the diameter of the base, such that a retaining ring 280 can be installed to the base. Retaining ring 280 can overhang and restrict edge 262 such that storage container cannot be removed with the retainer ring 280 installed.

Figure 5:
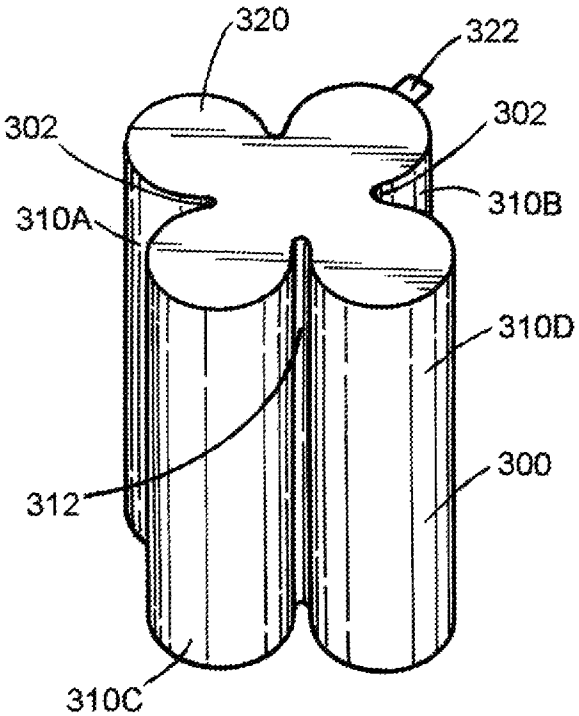
FIG. 5 illustrates an exemplary disposable container that can be purchased by a user, the container including a plurality of columns of tablets that can be inserted as a whole into a storage container, in accordance with the present disclosure.

Tablets can be provided in a pre-formed column, for example, wrapped in a paper or plastic wrapper, such that the wrapper can be removed and the column can be slid into a cavity in the storage container. In another embodiment, a plurality of tablets can be shipped in a container configured to be inserted as a whole into a storage container. FIG. 5 illustrates an exemplary disposable container that can be purchased by a user, the container including a plurality of columns of tablets that can be inserted as a whole into a storage container. Any number of columns of tablets can be provided for use in a matching storage container. Container 300 can be constructed of a thin plastic material. Container 300 includes a plurality of column wrappers 310A, 310B, 310C, and 310D, wherein the individual wrappers are joined in a center portion 312. Container 300 includes slots 302 that can be used to locate or fix container 300 within a storage container. A closure 320 can be initially installed for shipment and sale to container 300. A tab 322 is included upon closure 320 permitting a user to peel back closure 320 and open all four of the columns of tabs for use in a storage container.

Figure 6:
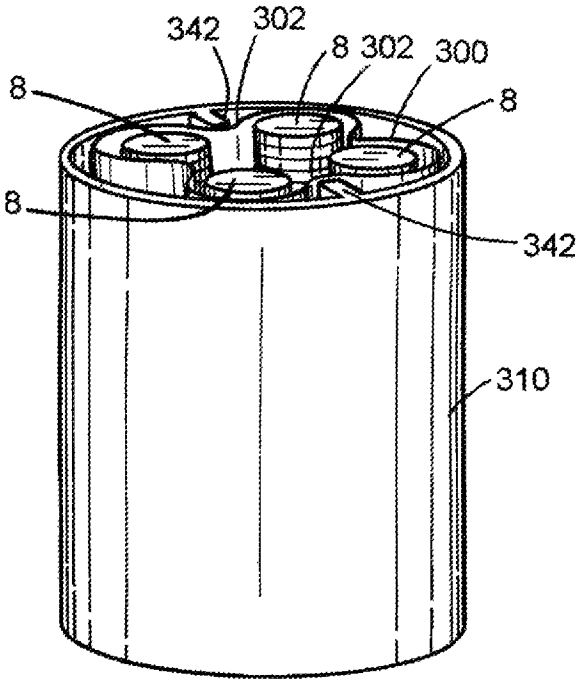
FIG. 6 illustrates the container of FIG. 5 installed to an exemplary matching storage container, in accordance with the present disclosure.

FIG. 6 illustrates the container of FIG. 5 installed to an exemplary matching storage container. Storage container 310 includes container 300 installed thereto with columns of tablets 8 exposed to the open end of the storage container. Slots 302 are illustrated with matching tabs 342 of storage container 310 located to the slots, thereby positioning container 300 within the cavity of storage container 310.

Figure 7:
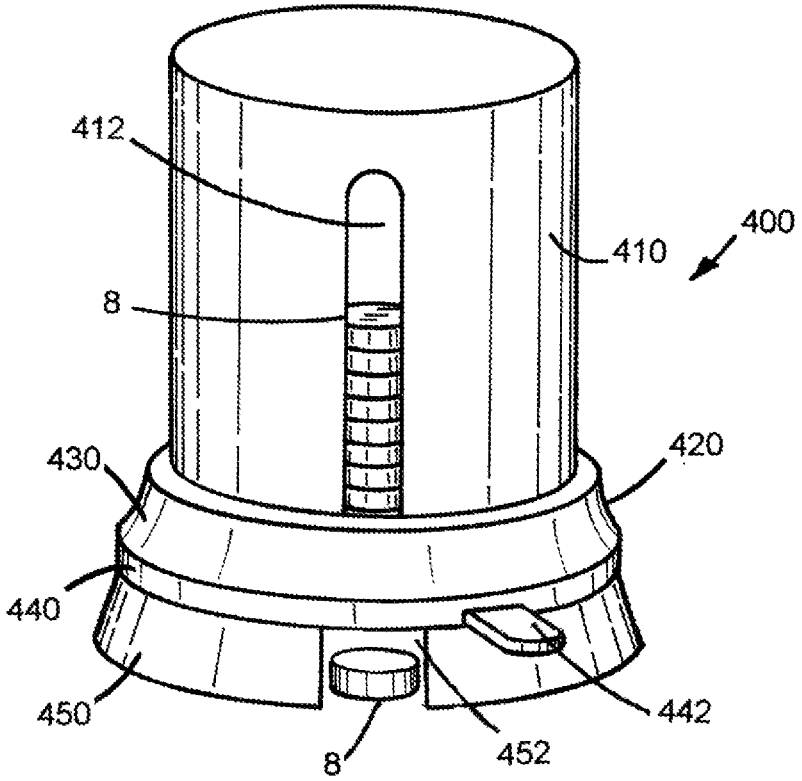
FIG. 7 illustrates an exemplary alternative embodiment of a dispenser including a rotating dispenser plate, in accordance with the present disclosure.

FIG. 7 illustrates an exemplary alternative embodiment of a dispenser including a rotating dispenser plate. Dispenser 400 includes storage container 410 and base 420 configured to dispense tablets 8 based upon rotation of tab 442. Storage container 410 includes an optional clear window 412 permitting a user to view how many tablets remain in a particular column. A window can be provided for each column within the storage container 410. Base 420 is illustrated including a base surface and container engagement ring section 430, a rotating plate section 440, and a base section 450. Tab 442 of section 440 can be rotated around the dispenser, for example, for a quarter turn, to dispense a tablet 8. Slot 452 is provided, wherein a tablet is dropped for a user to reach in and acquire the tablet.

Figure 8:
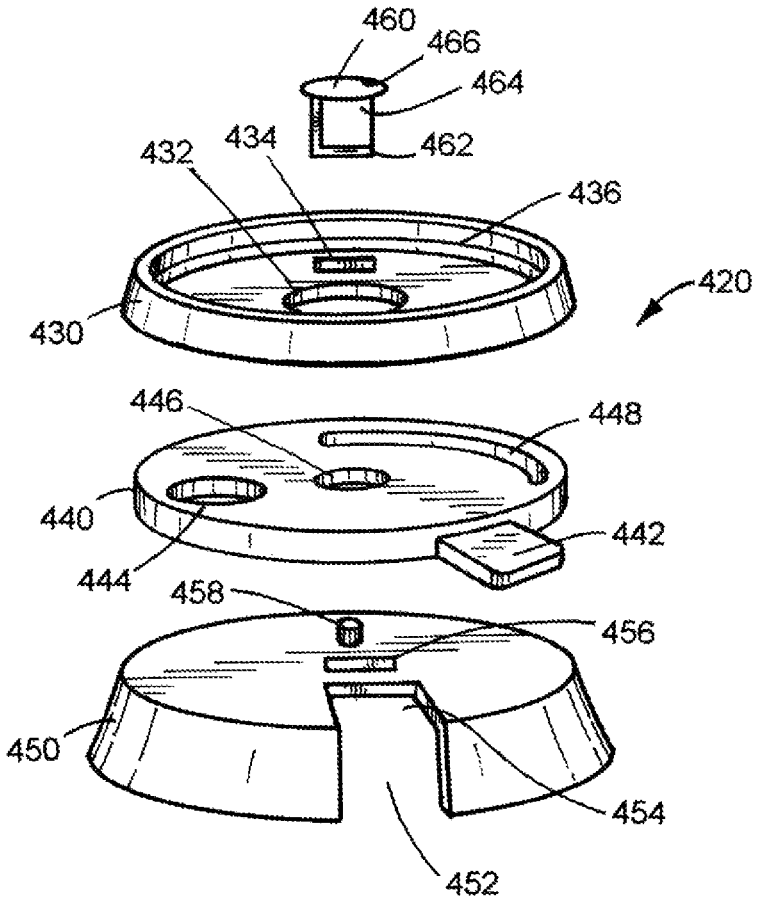
FIG. 8 illustrates the exemplary base of FIG. 7 in detail, in accordance with the present disclosure.

FIG. 8 illustrates the exemplary base of FIG. 7 in detail. Base 420 is illustrated including a base surface and container engagement ring section 430, a rotating plate section 440, and a base section 450. Section 430 is shaped to receive a storage container, includes a tongue and groove detail 436, includes hole 432 configured to receive and permit a tablet from column of tablets positioned above the hole 432 to fall therethrough, and include a slot 434 configured to receive a slotted pin 460 configured to hold the base 420 together. Section 440 includes hole 444 that can be aligned to hole 432 to selectively permit a tablet to fall therethrough based upon rotation of section 440 by movement of tab 442. Hole 446 is circular, such that slotted pin 460 does not stop section 440 from rotating. Slot 448 is configured to accept a pin 458 on section 450 limiting a range of rotation of section 440. Section 450 rests upon a surface such as a counter-top, includes pin 458, slot 456 accepting slotted pin 460, and slot 452 including opening 454 configured to permit a tablet to fall from hole 444 through opening 454. Slotted pin 460 includes flat top 466, rectangular section 464, and snap feature 462 permitting the pin to be locked into position, sandwiching sections 430, 440, and 450 together and stopping sections 430 and 450 from rotating relative to each other.

Holes such as hole 42 wherein a tablet is to drop through can include a hole diameter slightly larger than the diameter of the tablet to avoid the tablet getting bound up in the hole. For an exemplary tablet that is ⅞" in diameter, a 1" hole can be used. Similarly, any slot or sandwich of plates, such as is created in hole 444, that are to carry a flat tablet therebetween should include at least the thickness of the tablet. However, if too much space is left in such a configuration, two tablets can feed into the space. In one exemplary embodiment, a tablet can be 4 mm thick.

Figure 9:
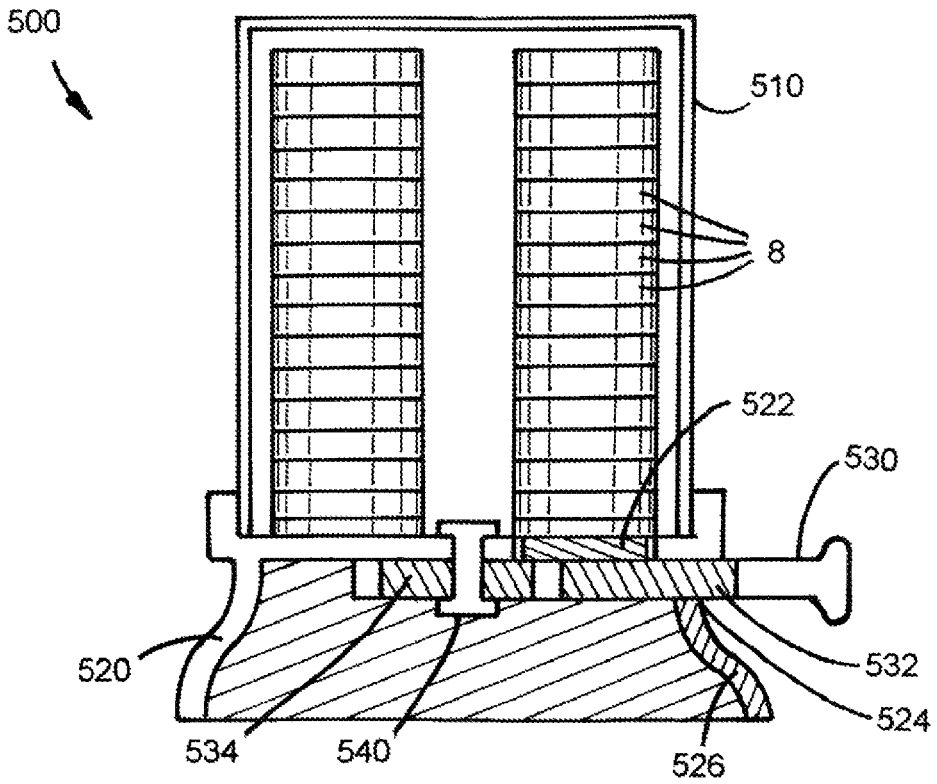
FIG. 9 illustrates an exemplary alternative embodiment of a dispenser including a push pull tab dispenser, in accordance with the present disclosure.

FIG. 9 illustrates an exemplary alternative embodiment of a dispenser including a push pull tab dispenser. Dispenser 500 includes storage container 510 and base 520. Storage container 510 includes a plurality of columns of tablets 8 and is configured to rotate relative to base 520. Base 520 includes hole 522 configured to receive a tablet. Base 520 includes opening 524 configured to receive push pull tab 530. Push pull tab 530 includes a hole 532 that can be selectively aligned with hole 522 permitting a tablet to fall therethrough. Tab 530 includes a slot 534 configured to accept an exemplary rivet 540 configured to position tab 530 and permit the tab to be moved in and out. Base 520 further includes a slot 526 permitting a user to reach in and acquire a tablet that drops through hole 532. Base 520 can be termed as an actuable cyclic tablet dispensing mechanism, receiving tablets through an input hole (hole 522) from storage container 510.

Figure 10:
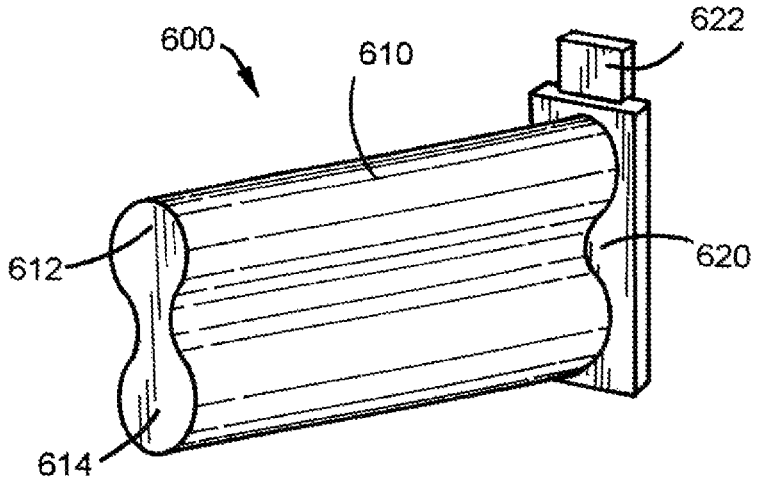
FIG. 10 illustrates an exemplary alternative embodiment of a dispenser including a push pull tab dispenser and spring loaded tablet columns, in accordance with the present disclosure.

FIG. 10 illustrates an exemplary alternative embodiment of a dispenser including a push pull tab dispenser and spring loaded tablet columns. Hand-held dispenser 600 includes storage container 610 and base 620. Storage container 610 includes two column cavities 612 and 614. Each of the cavities includes a spring mechanism, providing a force pushing tablets within the cavities against the base 620. Base 620 can be rotated relative to storage container 610 permitting a user to selectively dispense tablets from either of the tablet columns contained within storage container 610. Base 620 includes button 622 that can be pushed or pulled to dispense a tablet from dispenser 600. Button 622 can be spring loaded to be biased to a first position, where pressing of button 622 overcomes the bias and moves the button to a second position whereat a tablet is dispensed.

Figure 11:
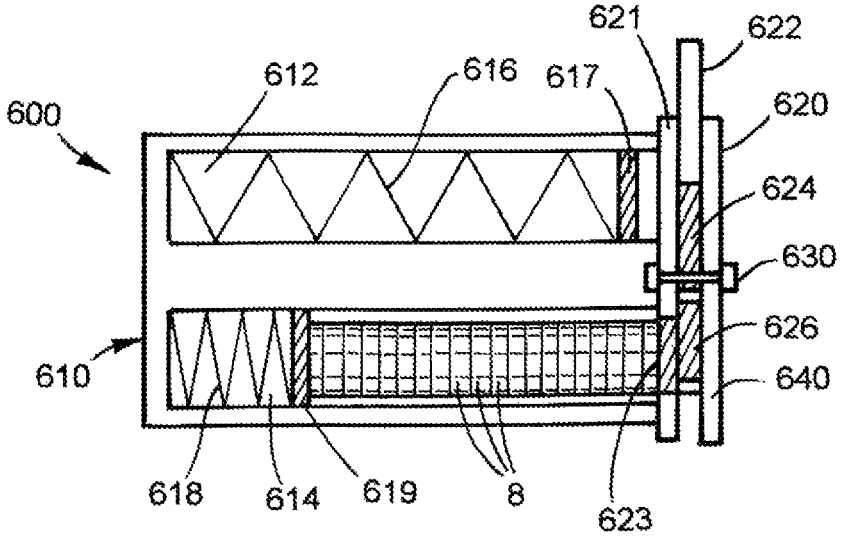
FIG. 11 illustrates the dispenser of FIG. 10 in cross-section, in accordance with the present disclosure.

FIG. 11 illustrates the dispenser of FIG. 10 in cross-section. Dispenser 600 includes storage container 610 and base 620. A container 610 can be snapped onto base 620, for example, with the user removing, rotating, and reinstalling the container when a first column is used up. In another embodiment, pin 630 connects and permits rotation of container 610 to base 620. In one embodiment, dispenser 600 is pre-assembled and disposable. In another embodiment, container 610 can be removed, refilled, and reinstalled to base section 620. In another embodiment, container 610 can be rotated to a particular orientation, wherein tablets can be pressed into each of the cavities in order to fill the dispenser. Each of cavities 612 and 614 include a tablet spring 616 and 618, respectively, and a tablet base plate 617 and 619, respectively. Springs 616 and 618 can be termed spring loaded plungers forcing the columns of tablets toward the input hole of the dispenser. Base 620 includes hole 623 permitting a tablet to pass through from cavity 614. Base 620 includes button 622 which includes a slot 624 interacting with pin 630, thereby permitting the button to move in and out, and hole 626 permitting a tablet to move from hole 623 to hole 626. By pressing button 622, a tablet can be cycled through holes 626 and dispensed to the user. Plate 640 contains button 622 and can include an opening permitting a tablet to move from hole 626 to outside the dispenser. Base 620 can be termed as an actuable cyclic tablet dispensing mechanism, receiving tablets through an input hole (hole 622) from storage container 610.

Figure 12:
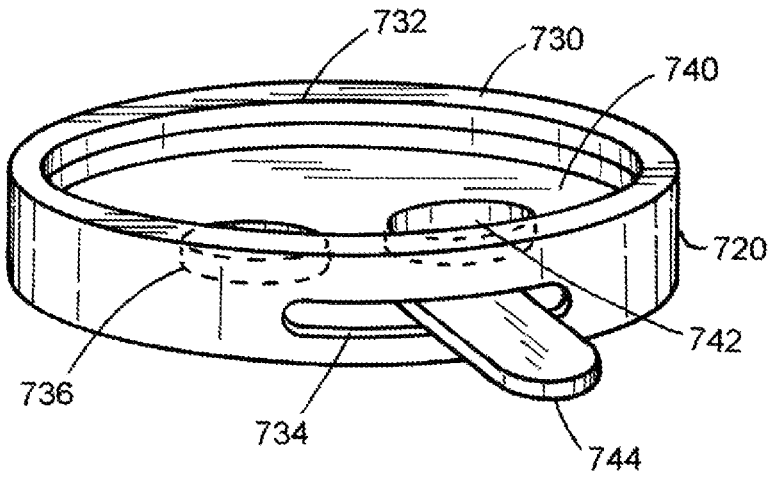
FIG. 12 illustrates an exemplary alternative embodiment of a base for use with a dispenser, wherein a base section includes a slot permitting a tabbed rotating plate to be situated within the base section, in accordance with the present disclosure.

FIG. 12 illustrates an exemplary alternative embodiment of a base for use with a dispenser, wherein a base section includes a slot permitting a tabbed rotating plate to be situated within the base section. Base 720 includes base section 730 and tabbed flat plate 740. Base section 730 is configured to receive a storage container and includes a tongue and groove feature 732. Tabbed flat plate 740 fits within base section 730 and tab 744 of plate 740 fits through slot 734 of base section 730. Plate 740 includes hole 742 configured to receive a tablet as disclosed herein. As tab 744 is moved, a tablet can be fed to hole 736 in base section 730, permitting the tablet to fall through hole 736.

Figure 13:
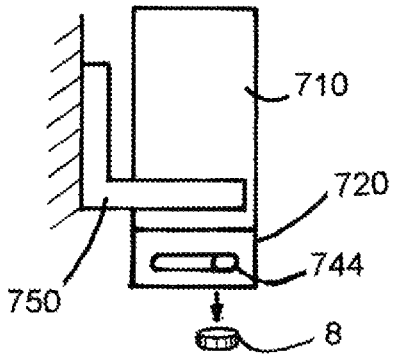
FIG. 13 illustrates an exemplary dispenser configured as a wall mounted dispenser configured for easy access to a disabled user, in accordance with the present disclosure.

FIG. 13 illustrates an exemplary dispenser configured as a wall mounted dispenser configured for easy access to a disabled user. Base 720 of FIG. 12 is assembled to a storage container 710 and a wall bracket 750. Tab 744 can be easily cycled, for example, by a user with arthritis or other physical disability by simply pushing on the tab, thereby causing tablet 8 to be dropped from the dispenser.

Figure 14:
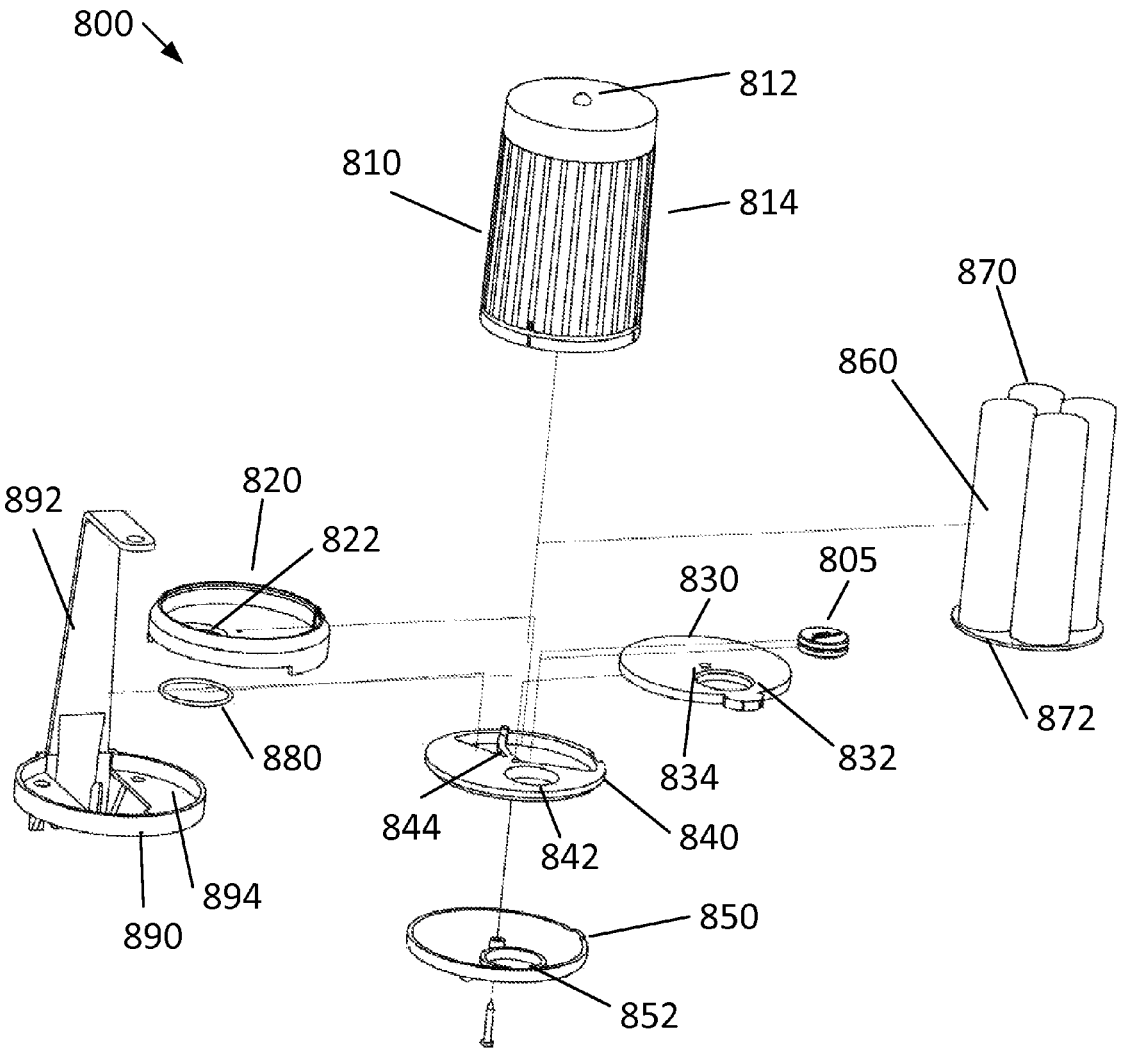
FIG. 14 illustrates in schematic assembly view an exemplary dispenser including an easy install cartridge and a wall mount permitting rotation of a cylindrical storage container, in accordance with the present disclosure.

FIG. 14 illustrates in schematic assembly view an exemplary dispenser including an easy install cartridge and a wall mount permitting rotation of a cylindrical storage container. Dispenser 800 is illustrated including cylindrical storage container 810, container base plate 820, and dispenser base plate 850. Stage container 810 and container base plate 820 rotatably connect together and create a cavity therebetween to store a plurality of columns of tablets 805. In the exemplary embodiment of FIG. 14, tablets are provided in a disposable easy install cartridge 860. Cartridge 860 includes a plurality of tube sections 870 and a flat base section 872. Cartridge 860 is installed to the inner portion of storage container 810, and container 810 is then installed to plate 820, such that flat base section 872 is resting upon the flat surface of plate 820. Container 810 is keyed to cartridge 860, such that the two turn in unison, and container 810 when turned lines up any of the four tube sections with hole 822 of plate 820. In this way, tablets within cartridge 860 can be aligned and provided within dispenser 800. In one embodiment, the flat section of container base plate 820 is relatively thin and hole 822 can include generously radiused or angled corners, such that a column of tablets sitting within a tube section 870 of cartridge 860 passing over hole 822 will easily be able to be rotated past the hole, with the tablets falling into hole 822 and being eased out of hole 822 by the rotating motion of cartridge 860 and container 810 relative to container base plate 820.

Starting with a depleted cartridge 860 within dispenser 800, installation of a new cartridge 860 to container 810 will typically include removing container 810 from plate 820 and flipping over container 810. The depleted cartridge 860 is removed and the new cartridge 860 is installed. The remainder of dispenser 800, including plate 820 and 850 encasing plates 830 and 840, can be described as an actuable cyclic tablet dispensing mechanism. Hole 822, which is selectively aligned to one a plurality of tablet columns stored in storage container 810, can be termed an input hole for the dispensing mechanism. The actuable cyclic tablet dispensing mechanism is flipped and installed to the flipped container 810 including the new cartridge 860 to recreate the dispenser 800. Dispenser 800 can then be flipped back to upright and installed to wall bracket 890.

Container base plate 820 and dispenser base plate 850 connect together and create a cavity therebetween to house a stationary bottom plate 840 and a rotating dispenser plate 830 to create a spring loaded mechanism for selectively presenting a hole for 832 for a tablet to drop into in order to be dispensed from dispenser 800, the assembly of plates being termed as an actuable cyclic tablet dispensing mechanism or a dispensing mechanism. Stationary bottom plate 840, as illustrated, includes an integrated spring feature 844 which is connected to dispenser plate 830. Dispenser plate 830 includes a tab which can be actuated to rotate dispenser plate 830 relative to plates 820, 840, and 850, which remain stationary. Through the rotation of dispenser plate 830, hole 832 is selectively aligned with hole 822 of plate 820, such that a tablet 805 can fall into hole 832. Because hole 820 and hole 842 of stationary bottom plate 840 are offset, a tablet falling into hole 832 when holes 832 and 822 are aligned will not fall out of the dispenser. Such an alignment of hole 822 and 842 would cause an entire column of tablets to immediately fall out of the dispenser. Instead, dispenser plate 830 has a thickness selected such that a single tablet 805 can fit within hole 832 and rest upon a flat surface of plate 840, and as dispenser plate 830 is rotated into alignment with hole 842, the single tablet can fall out of the dispenser. Dispenser base plate 850 includes hole 852 aligned with hole 842.

Denture tablets include chemicals that react to water. A column or set of tablets can be ruined by exposing them prematurely to water. In one exemplary embodiment, an o-ring 880 or a plurality of o-rings can be used to make dispenser 800 resistant to water intrusion. Such an o-ring can be used in a number of locations within the dispenser to seal one surface against another surface, for example, with the o-ring 880 being held in a circular channel, with a small portion of o-ring 880 extending above a surface of the part and connecting with a neighboring part, such that the o-ring is elastically deformed and creates a sealing contact with the neighboring part. In the illustrated exemplary embodiment of FIG. 14, a ring-shaped channel can be formed around hole 822 on a bottom surface of container base plate 820, such that the o-ring 880 causes the container plate to seal against the flat surface of a top side of dispenser base plate 830. In an alternative embodiment, a ring-shaped channel can be formed around hole 832 on a top surface of dispenser base plate 830, such that the o-ring 880 causes the dispenser plate to seal against the flat surface of a bottom side of container base plate 820. In this way, the cavity formed between container 810 and plate 820 containing cartridge 860 can be sealed, and moisture and humidity can be prevented from causing damage to the tablets within.

Plate 830 includes center hole 834, which accepts a post or rivet which permits the plate 830 to turn relative to plates 820, 840, and 850. In the exemplary embodiment of FIG. 14, plate 820, 840, and 850 also include center holes in alignment with hole 834, although in other embodiments, either plate 820 or 840 could project a post to extend through hole 834.

Wall bracket 890 is illustrated as a mechanism to securely mount dispenser 800 to a wall. Bracket 890 includes arm 892 configured to rotatingly connect to protruding feature 812 on top of container 810. Bracket 890 further includes base holding section 894 configured to accept dispenser base plate 850. According to one embodiment, in order to permit easy removal of dispenser 800 from bracket 890 so that the dispenser can be flipped over for refill, plate 850 and the holding section 894 can each include mating features that permit the dispenser 800 to be easily lifted out of holding section 894 but that prevent plate 850 from turning relative to holding section 894. With plate 850 and the rest of the dispensing mechanism (including plates 820, 830, and 840) held still, and with arm 892 permitting container section 810 to rotate relative to bracket 890, a user can selectively align one of the plurality of tablet columns within the container section 810 to the hole 822 in plate 820 such that the dispenser 800 can operate.

Figure 15:
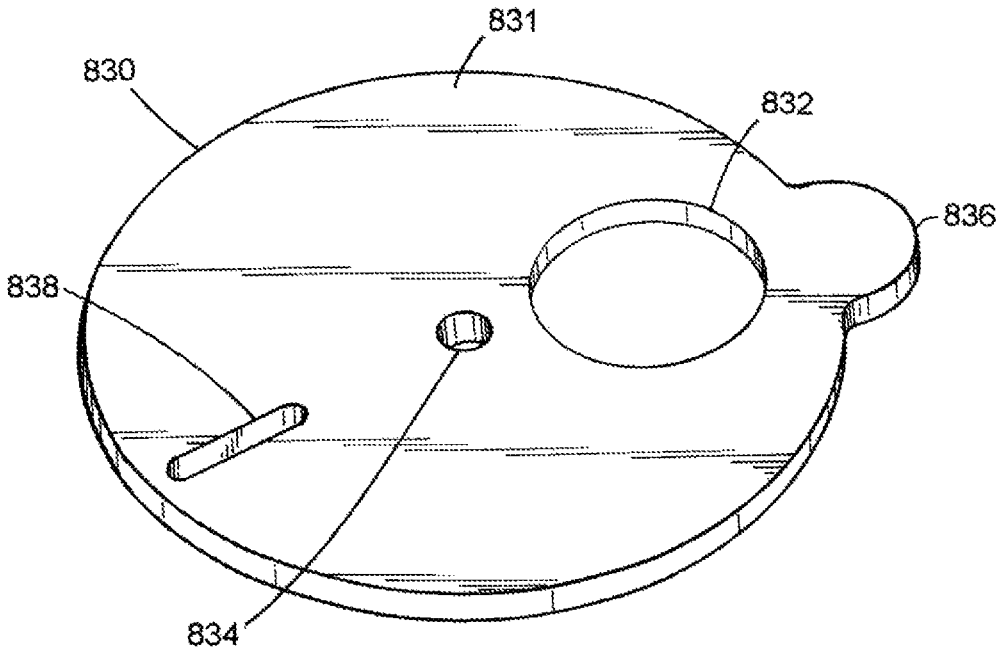
FIG. 15 illustrates the exemplary dispenser plate of FIG. 14 including a spring feature receiving slot, in accordance with the present disclosure.

FIG. 15 illustrates the exemplary dispenser plate of FIG. 14 including a spring feature receiving slot. Dispenser plate 830 is illustrated including tab 836, hole 830, and center hole 834. Dispenser plate 830 is illustrated flipped over, such that a bottom side 831 is visible. Spring feature receiving slot 838 is illustrated, ready to receive a post from a spring feature located on neighboring stationary bottom plate 840.

Figure 16:
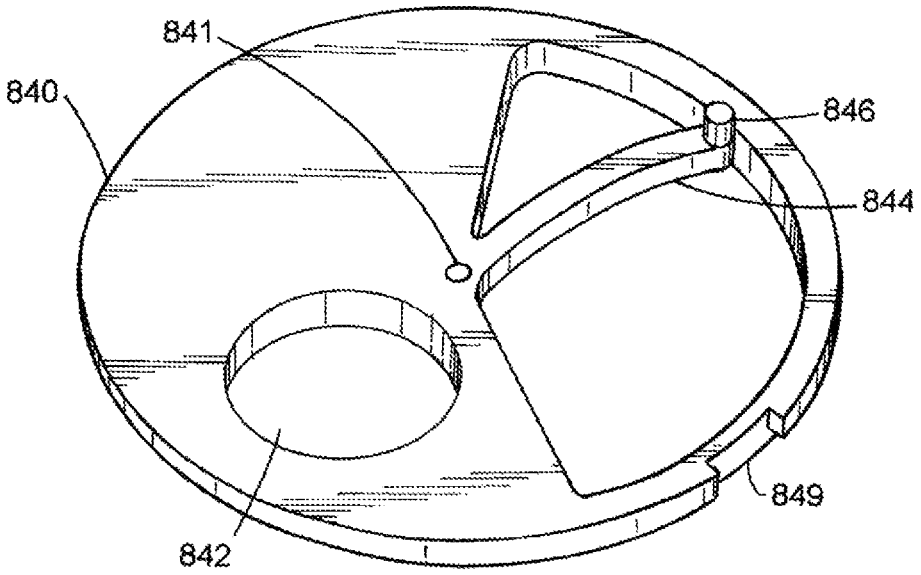
FIG. 16 illustrates the exemplary bottom plate of FIG. 14 including an integrated spring feature, in accordance with the present disclosure.

FIG. 16 illustrates the exemplary stationary bottom plate of FIG. 14 including an integrated spring feature. Stationary bottom plate 840 is illustrated including hole 842, center hole 841, and spring feature 844 including spring feature post 846. Exemplary spring feature 844 is illustrated as an arm configured to bend an apply a spring force or torsion to dispenser plate 830 as it is turned, causing plate 830 to return to an original position as force is removed from tab 836. Spring feature 844 can utilize elastic deformation of the material of plate 840 made of ABS plastic or polypropylene to provide the spring force. The spring feature can be configured to accept or be molded with a piece of spring steel therewithin to provide repeatable and reliable spring force. Bottom plate 840 can alternatively be configured to receive a spring feature entirely made up of spring steel, such that features of plate 840 act as a holding feature for the ancillary spring feature. In another embodiment, plate 840 can be constructed of a thin piece of spring steel, with post 846 being riveted in place. Bottom plate 840 includes exemplary securing feature 849 which secures to a matching feature on dispenser base plate 850 to prevent plate 840 from turning relative to plates 850 and 820. One will appreciate that, in the alternative, the spring feature could be located on the dispenser plate and the slot interacting with the spring feature can be located on the stationary bottom plate. Spring feature 844 is illustrated as an exemplary arm connected to the rest of the stationary bottom plate 840, with the spring force being supplied by flexing the arm from its original orientation and elastic forces in the arm causing the arm to provide a force to return to its original orientation. One will appreciated that other springs and spring mechanisms, for example utilizing coil springs or a pair of spring steel levers could be used to provide the spring force, and the disclosure is not intended to be limited to the examples provided herein.

One will further appreciate that the stationary bottom plate need not be a separate piece from the dispenser base plate or the container base plate, with one of the spring feature or the slot being located on one of the dispenser base plate or the container base plate, and with the mating spring feature or slot being located upon the dispenser plate. In such a configuration, one could say that the stationary bottom plate is formed unitarily with the dispenser base plate or formed unitarily with the container base plate.

Figure 17:
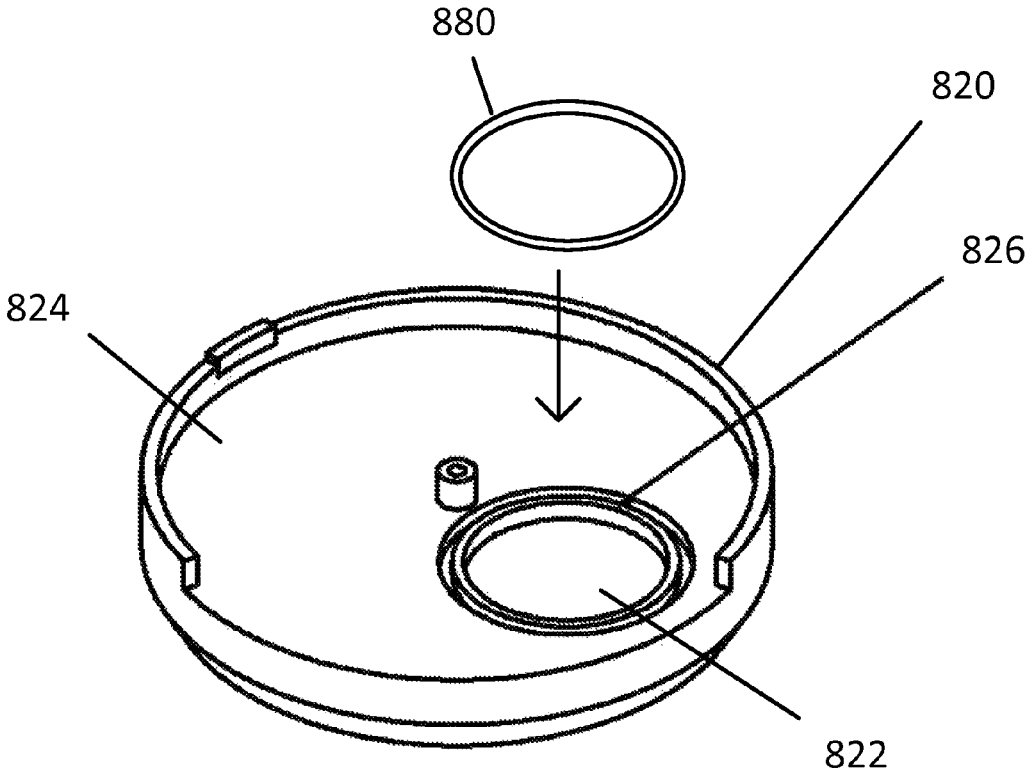
FIG. 17 illustrates the container base plate of FIG. 14 in detail including an exemplary o-ring channel that can make the dispenser resistant to water intrusion, in accordance with the present disclosure.

FIG. 17 illustrates the container base plate of FIG. 14 in detail including an exemplary o-ring channel that can make the dispenser resistant to water intrusion. Plate 820 includes hole 822 and o-ring channel 826 configured around hole 822 on bottom surface 824 of plate 820. Bottom surface 824 abuts the flat top surface of dispenser plate 830 when the two are assembled into the dispensing mechanism. When o-ring 880 is installed to o-ring channel 826, the o-ring seals to the flat surface of plate 830, thereby preventing moisture and humidity from entering the cavity formed by container 810 and plate 820.

Figure 18:
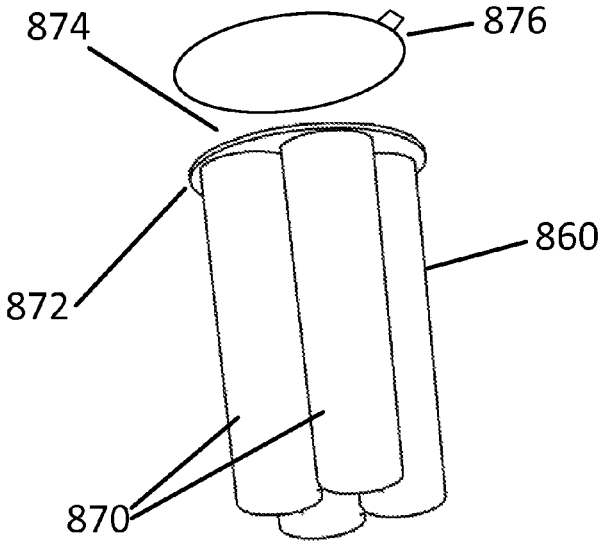
FIG. 18 illustrates an exemplary cartridge of FIG. 14, in accordance with the present disclosure.

FIG. 18 illustrates an exemplary cartridge of FIG. 14. Cartridge 860 includes a plurality of tube sections 870, each configured to hold a column of tablets. Tube sections 870 are each attached or formed unitarily with flat section 872 which is configured to rest upon a top flat section of plate 820. Cartridge 860 can be refillable. Cartridge 860 can be disposable (and made of recyclable material.) In the embodiment of FIG. 18, a foil seal 876 is illustrated removed from a open side 874 of cartridge 860. The cartridge can be manufactured according to a number of methods, for example, by injection molding, blow molding/vacuum forming, and by attaching (e.g. gluing, sonic welding, or any similar process known in the art) a plurality of tube sections to a carrier piece forming flat section 872. In one embodiment, the tub sections can be a thin film, capable of being easily crushed when the tablets are removed or depleted.

Dispensers as disclosed herein can be constructed of any of a number of materials including plastic materials known in the art and approved for use in household medical devices.

A number of different dispenser embodiments are disclosed herein. A number of different embodiments and configurations of features are envisioned for use with the provided examples, and the disclosure is not intended to be limited to the specific examples provided herein. According to one group of embodiments of the disclosure, a tablet dispenser can include a turning storage container installed to an actuable cyclic tablet dispensing mechanism, wherein the storage container contains a plurality of columns of tablets that can be selectively aligned to an input hole of the actuable cyclic tablet dispensing mechanism. The dispensing mechanism can include any of a number of envisioned mechanical devices, including non-limiting exemplary embodiment of a rotating plate as disclosed in relation to FIGS. 8 and 14, a push-pull slider as disclosed in relation to FIG. 9, a spring-loaded push slider as disclosed in relation to FIG. 10, and a slot for manual tablet removal as disclosed in relation to FIG. 1. Tablets in the columns can be fed by gravity or forced toward the dispensing mechanism with a spring.

The disclosure has described certain preferred embodiments and modifications of those embodiments. Further modifications and alterations may occur to others upon reading and understanding the specification. Therefore, it is intended that the disclosure not be limited to the particular embodiment(s) disclosed as the best mode contemplated for carrying out this disclosure, but that the disclosure will include all embodiments falling within the scope of the appended claims.

The invention claimed is:

1. Apparatus comprising a dispenser for providing denture cleaning tablets, the apparatus comprising:

a rotatable storage container holding a plurality of columns of the tablets; and a dispensing mechanism comprising:

an input hole, wherein a user of the dispenser can acquire a tablet through rotating the rotatable storage container to align one of the columns of tablets to the input hole and cycling the dispensing mechanism;

a container base plate removably engaging to the storage container;

a dispenser base plate connecting to the container base plate; and a rotating dispenser plate located between the container base plate and the dispenser base plate, wherein the dispenser plate comprises a hole selectively aligning with the input hole to cycle the dispensing mechanism;

wherein the mechanism comprises a spring feature causing the dispenser plate to return to an original position when the dispensing mechanism is cycled;

wherein the spring feature is formed upon a stationary bottom plate; and wherein the spring feature comprises an arm formed unitarily with stationary bottom plate.

2. The apparatus of claim 1, wherein the plurality of columns of tablets comprise a replaceable cartridge.

3. The apparatus of claim 2, wherein the cartridge is refillable.

4. The apparatus of claim 2, wherein the cartridge comprises a disposable cartridge initially filled with the tablets.

5. The apparatus of claim 1, wherein the dispensing mechanism further comprises:

an o-ring sealing the dispensing mechanism such that the dispenser is resistant to water intrusion to the columns of tablets.

6. The apparatus of claim 5, wherein the o-ring seals between the dispenser plate and the container base plate.

7. The apparatus of claim 1, wherein the spring feature comprises a spring steel piece providing a portion of spring force for the spring feature.

8. The apparatus of claim 1, further comprising a wall bracket holding the dispensing mechanism.

9. Apparatus comprising a dispenser for providing denture cleaning tablets, the apparatus comprising:

a rotatable storage container holding a plurality of columns of the tablets;

a dispensing mechanism comprising an input hole, wherein a user of the dispenser can acquire a tablet through rotating the rotatable storage container to align one of the columns of tablets to the input hole and cycling the dispensing mechanism; and a wall bracket holding the dispensing mechanism, the wall bracket comprising:

features preventing the dispensing mechanism from rotating relative to the wall bracket but permitting the dispenser to be lifted up away from the wall bracket; and an arm affixing to a top of the storage container while permitting the storage container to rotate relative to the wall bracket.

* * * * *